United States Patent [19]

Pollmeier et al.

[11] Patent Number: 4,530,294

[45] Date of Patent: Jul. 23, 1985

[54] TUBULAR-GOODS HOLDER FOR SEWING MACHINE

[75] Inventors: Konrad Pollmeier, Bielefeld; Philipp Moll, Aachen, both of Fed. Rep. of Germany

[73] Assignee: Durkoppwerke GmbH, Bielefeld, Fed. Rep. of Germany

[21] Appl. No.: 597,448

[22] Filed: Apr. 6, 1984

[30] Foreign Application Priority Data

Apr. 6, 1983 [DE] Fed. Rep. of Germany ..... 3312317

[51] Int. Cl.[3] ..... D05B 35/06

[52] U.S. Cl. ..... 112/63; 112/121.26; 112/260; 112/121.27; 38/102.1

[58] Field of Search ..... 112/63, 121.26, 121.27, 112/262.2, 14, 260; 226/175; 38/102.1, 102.3, 38/102.4

[56] References Cited

U.S. PATENT DOCUMENTS

| | | | |
|---|---|---|---|
| 2,074,929 | 3/1937 | Martin . | |
| 2,766,709 | 10/1956 | Stevens . | |
| 3,448,707 | 6/1969 | Thomsen | 112/121.26 |
| 3,635,779 | 1/1972 | Cooper | 226/175 X |
| 4,185,570 | 1/1980 | Kleinschmidt et al. | 112/121.27 X |
| 4,287,842 | 9/1981 | Breck, Jr. . | |
| 4,467,734 | 8/1984 | Rohr | 112/63 |

FOREIGN PATENT DOCUMENTS

| | | |
|---|---|---|
| 1485439 | 9/1969 | Fed. Rep. of Germany . |
| 2202036 | 3/1973 | Fed. Rep. of Germany . |
| 2155068 | 10/1982 | Fed. Rep. of Germany . |
| 2948498 | 11/1982 | Fed. Rep. of Germany . |
| 37611 | 10/1965 | German Democratic Rep. . |

*Primary Examiner*—Werner H. Schroeder
*Assistant Examiner*—Andrew M. Falik
*Attorney, Agent, or Firm*—Karl F. Ross; Herbert Dubno

[57] ABSTRACT

An apparatus for holding tubular goods for stitching at the station of a sewing machine has a support adjacent the sewing station, a drive for rotating the support about a horizontal support axis, and at least three arcuate segment plates displaceable radially of the support axis on the support and together forming a segmented drum centered on the axis. The plates are displaceable between inner positions defining a circumference smaller than that of the smallest tubular goods to be sewn and outer positions defining a circumference larger than that of the largest tubular goods to be sewn. The plates can be radially spread on the support to change the diameter of the drum. Thus when a tubular workpiece is fitted over the drum it is tensioned thereover. The support can also be displaced vertically adjacent the station to align the uppermost segment plate generally with the stitch plate. The support is a disk formed with respective radial guides and the plates have radially extending elements received in the respective guides. The radial elements have radially outer ends pivoted on the respective plates and radially inner ends.

12 Claims, 6 Drawing Figures

TUBULAR-GOODS HOLDER FOR SEWING MACHINE

FIELD OF THE INVENTION

The present invention relates to an apparatus for holding tubular goods for stitching by a sewing machine. More particularly this invention concerns an apparatus for stitching belt loops or the like on a waistband of generally inelastic goods.

BACKGROUND OF THE INVENTION

A sleeve stitching machine is known from German Pat. No. 2,155,068 which has two drum-shaped goods supports movable relative to the sewing machine. These supports are provided with goods-holding clips, one of which can hold the partly stitched cuff and the other the sleeve. The two clips can be coupled to bring the sleeve into the open end of the cuff, whereupon both parts are clamped in a rotatable drum while the ends are stitched together. The drum of such a machine is not capable of compensating for different sizes of goods at all so that whenever goods size change it is necessary to change holders too.

It has also been suggested in German Pat. No. 2,948,498 to use two driven holding elements which are set up for receiving and holding tubular goods. Such an arrangement cannot, however, hold tubular goods such as trousers or skirts for mounting belt loops on them. The amount of loops that must be stitched on is normally the same, regardless of waist dimension, so that this arrangement cannot be set up to put the right number on regardless of this size.

OBJECTS OF THE INVENTION

It is therefore an object of the present invention to provide an improved apparatus for holding tubular goods for stitching by a sewing machine.

Another object is the provision of such a apparatus for holding tubular goods for stitching by a sewing machine which overcomes the above-given disadvantages, that is which can accommodate goods of widely varying size while being able to sew items on the goods at equal spacings.

SUMMARY OF THE INVENTION

An apparatus for holding tubular goods for stitching at the station of a sewing machine has according to this invention a support adjacent the sewing station, a drive for rotating the support about a horizontal support axis, and at least three arcuate segment plates displaceable radially of the support axis on the support and together forming a segmented drum centered on the axis. The plates are displaceable between inner positions defining a circumference smaller than that of the smallest tubular goods to be sewn and outer positions defining a circumference larger than that of the largest tubular goods to be sewn. The plates can be radially spread on the support to change the diameter of the drum. Thus when a tubular workpiece is fitted over the durm it is tensioned thereover. The support can also be displaced vertically adjacent the station to align the uppermost segment plate generally with the stitch plate.

Such an arrangement allows goods of different size to be accommodated on the machine without readjustment. It is even possible to work on goods of different size one after the other with no adjustment whatsoever of the machine.

The support according to this invention is a disk formed with respective radial guides and the plates have radially extending elements received in the respective guides. In addition the radial elements have radially outer ends pivoted on the respective plates and radially inner ends. The spreading device includes an actuating element displaceable axially on the support disk and respective links each having one end pivoted on the respective inner end and an opposite end pivoted on the actuating element. Each plate is provided with a spring for urging it into a position extending parallel to the support axis.

According to another feature of this invention the drive includes a tube shaft centered on the axis and carrying the support disk. The spreader includes a core shaft extending coaxially inside the tube shaft and carrying the actuating element. The drive is set to move the drum through a predetermined angle with each stitching operation. Thus, regardless of goods size, the loops stitched to it will be perfect.

It is also possible for the support disk to be releasably connected to the tube shaft and for the actuating element to be releasably connected to the core shaft. This makes it possible to replace the drum with one capable of accommodating a different range of sizes, so the same machine can also be readily adapted for use in stitching sleeves and waistbands, for instance.

This core shaft according to this invention extends through the support disk and has one end on one axial side connected to the actuating element and an opposite end on the other axial side thereof. The spreader includes an extensible and retractable actuator extending axially and connected to the opposite end of the core shaft.

The vertical-displacement unit of this invention includes a pivotal arm having an outer end rotatably carrying the support disk, a relatively stationary frame on which the other end of the arm is pivoted, and an extensible and retractable actuator connected between the frame and the arm between the ends thereof. A stepping motor is used to drive this arrangement, and control means is provided for synchronizing the rotation and vertical displacement of the drum so that same is moved vertically through a distance generally equal to its change in radius as the segment plates move between the inner and outer positions.

According to another feature of this invention loop-supply means is provided for feeding loops to be stitched to the sewing station. In addition the entire drum can be displaced limitedly parallel to its rotation axis for stitching of both ends of the loop without changing the drum diameter or vertical position.

DESCRIPTION OF THE DRAWING

The above and other features and advantages will become more readily apparent from the following, reference being made to the accompanying drawing in which.

SPECIFIC DESCRIPTION

Figure 1:
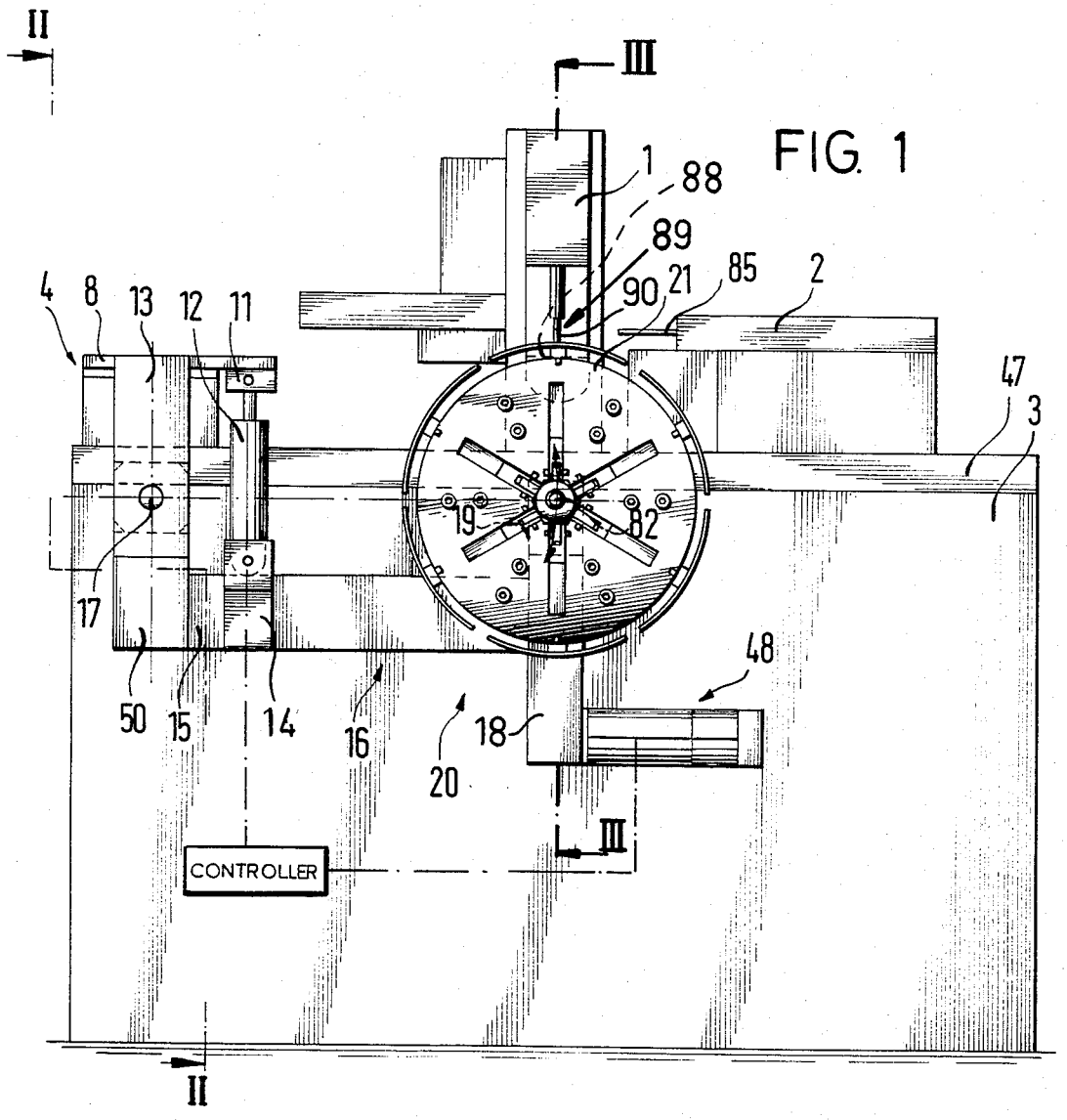
FIG. 1 is a partly diagrammatic side view of the apparatus according to the invention.
Figure 2:
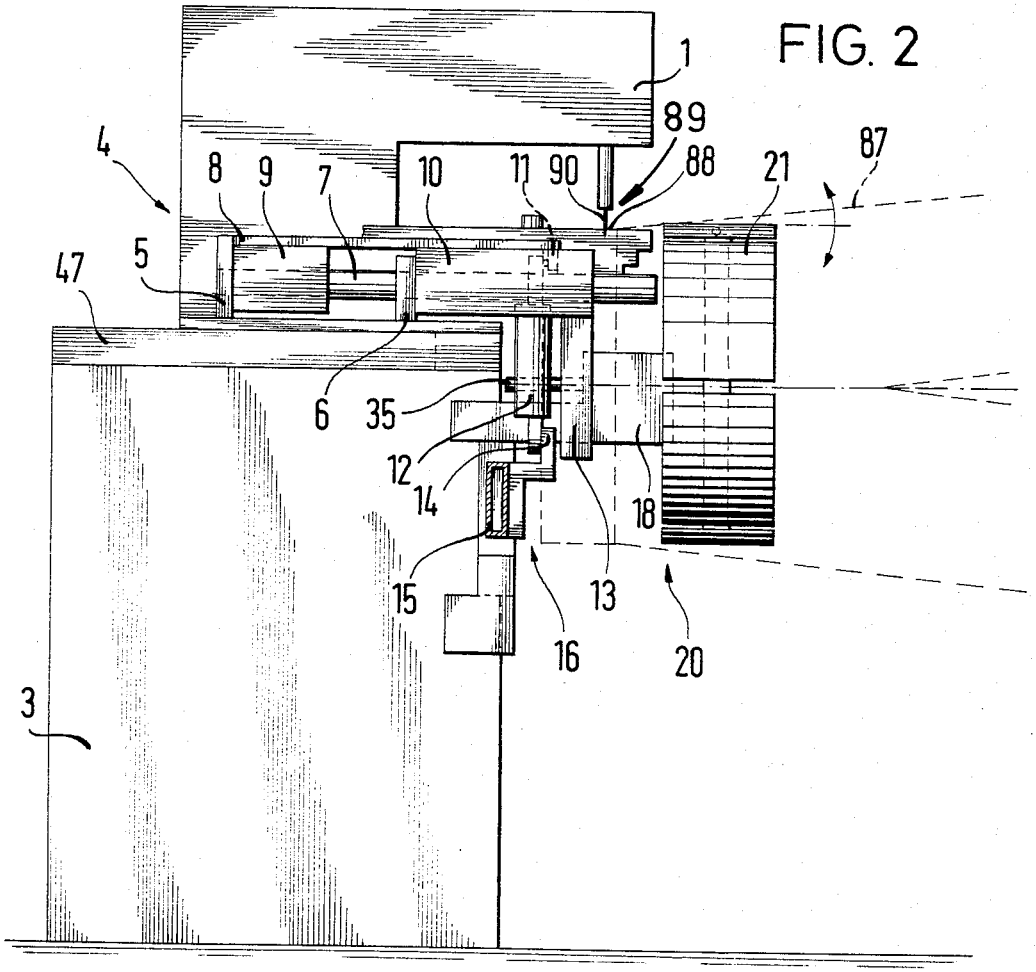
FIG. 2 is a section taken along line II—II of FIG. 1.
Figure 6:
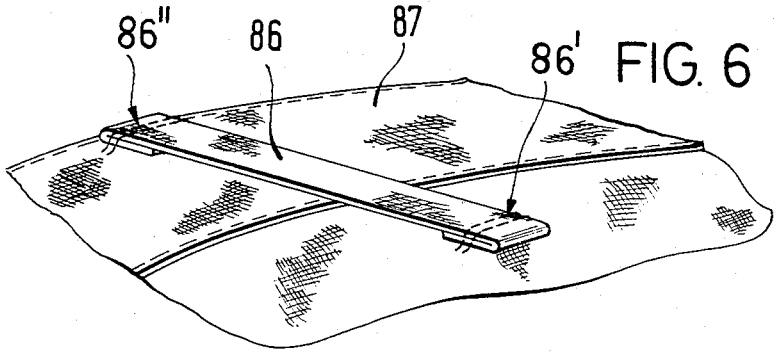
FIG. 6 is a perspective view showing a belt loop that is stitched on according to this invention.

As seen in FIGS. 1 and 2 a sewing machine 1 standing on a base 3 has a needle 90 vertically displaceable through a stitch plate 88 defining a sewing station 89. This standard equipment is used as also indicated in FIG. 6 to stitch a belt loop 86 on a tubular workpiece 87, here a pair of trousers, at an inner or lower stitch row 86′ and an outer or upper stitch row 86″. This is done with the aid of an automatic feeding device 2 which sits with the machine 1 on a top plate 47 of the base 3 of the apparatus. This feeder 2, which is known per se, cuts the belt loops 86 from a continuous supply thereof, and then folds the ends over by means of the fingers shown at 85 in FIG. 1. These fingers 85 position the thus formed loops in place under the needle 90 in the sewing station 89 so the operator can operated the sewing machine 1 to stitch them on.

The instant invention relates principally to a holder 20 for supporting the goods 87 in the station 89 under the needle 90. This holder 20 basically comprises a variable-diameter drum 21 rotatable about a horizontal axis 82 on an outer support 16 which is in turn limitedly pivotal about and displaceable along a horizontal axis 17 on an inner support 4 secured to the base 3. As will be described in more detail below, the goods 87 are fitted over this drum 21 when same is of minimal diameter, and this drum 21 is then expanded and pivoted about the axis 17 to position the edge of the goods 87 under the needle 90 in the sewing station 89. One end of the belt loop 86 is stitched on at 86′, the drum 21 is moved parallel to the axis 17 to stitch on the other end at 86″, and the goods 87 are rotated for similar mounting of the next loop 86.

The support 4 comprises two stationary blocks 5 and 6 fixed on the top plate 47 and holding at least one guide rod 7 extending parallel to the axis 17. Two guide sleeves 9 and 10 secured to a plate 8 are provided with roller bearings so they can move easily along this rod 7 through a distance at least equal to the distance between the rows of stitching 86′ and 86″ of the longest belt loop 86 likely to be encountered.

The front end of this plate 8 and the front guide sleeve 10 are fixed to a depending arm 13 whose lower end is provided with a shaft defining the axis 17. The outer support 16 basically comprises a beam 15 having an inner end 50 pivoted on the shaft and an opposite end 18 carrying the drum 21. A heavy-duty hydraulic cylinder 12 has its piston rod connected at 11 to the plate 8 and its cylinder connected at 14 to the arm 15. The cylinder 12 can therefore pivot the outer support 16 relative to the inner support 4 about the axis 17, while still allowing both supports 4 and 16 to move along the rod 7 parallel to this axis 17.

Figure 3:
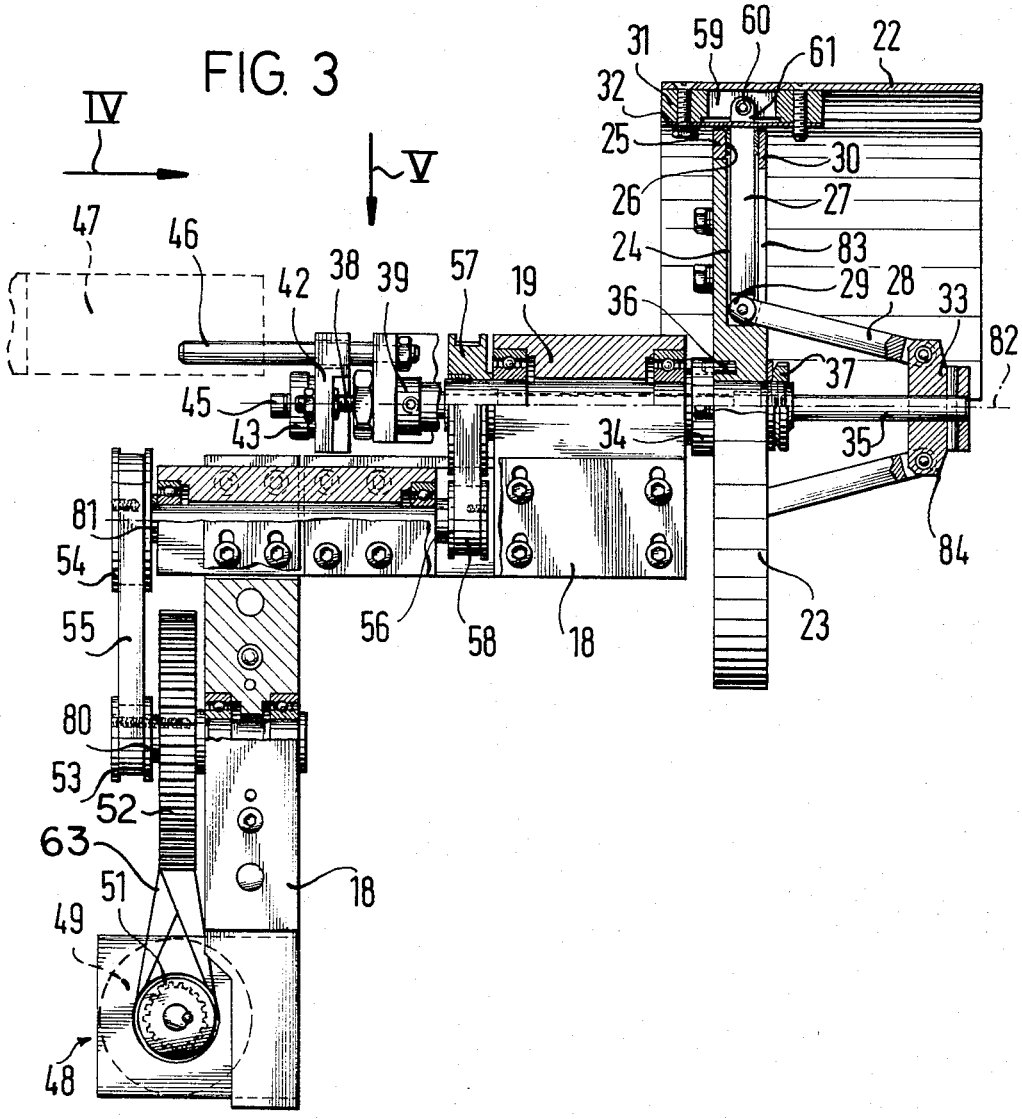
FIG. 3 is a large-scale section taken along line III—III of FIG. 1.
Figure 4:
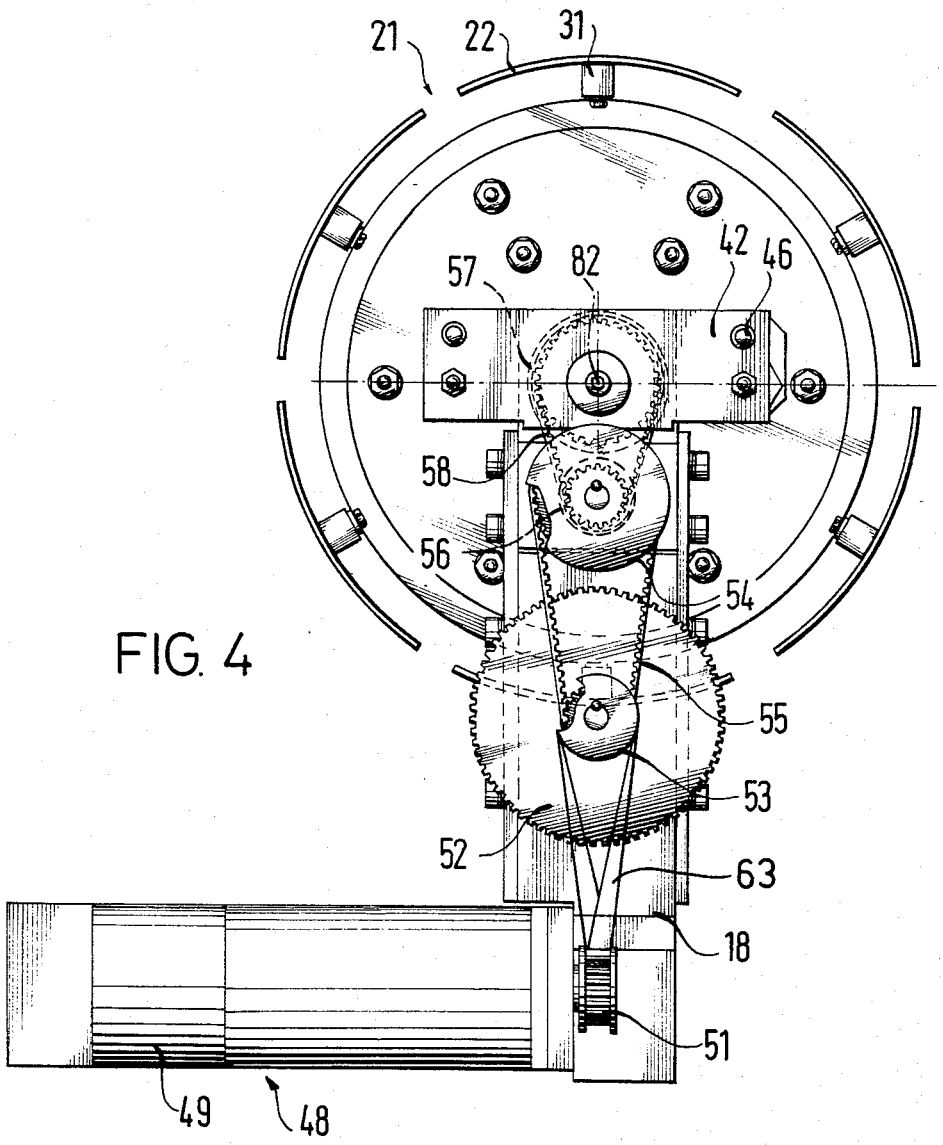
FIGS. 4 and 5 are side and top views taken in the directions of respective arrows IV and V of FIG. 3.
Figure 5:
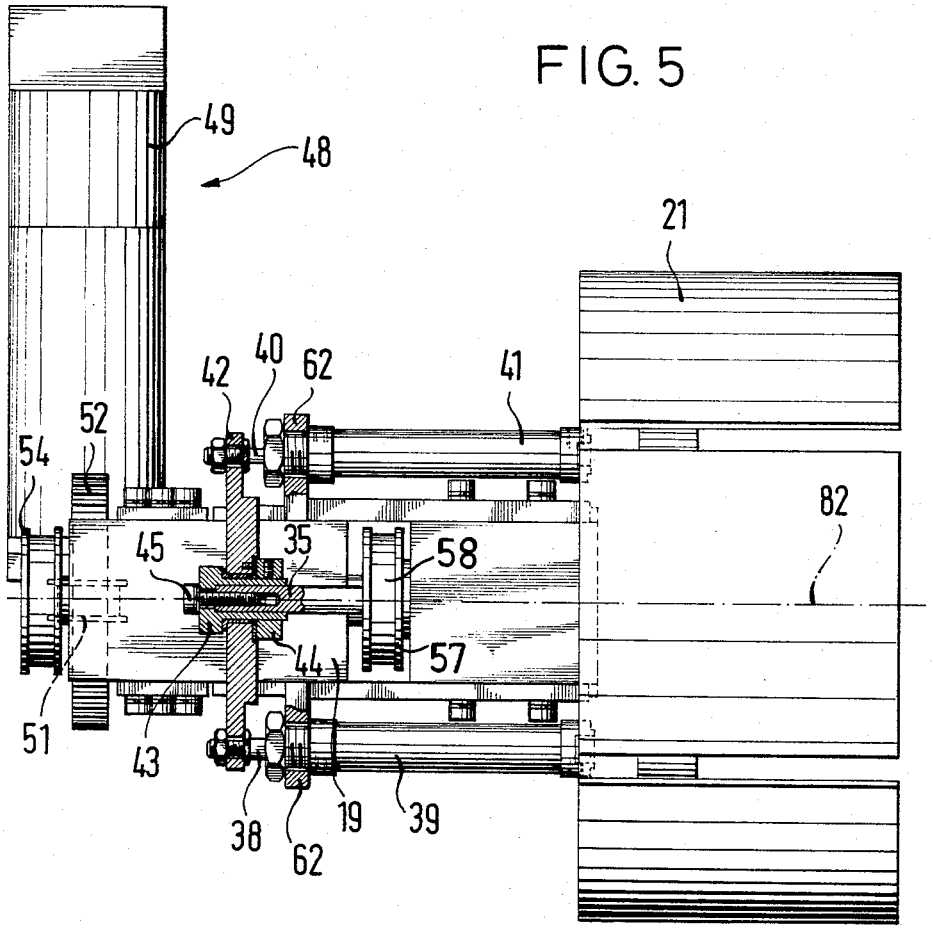

As best seen in FIGS. 3 and 4, the drum 21 comprises six identical and part-cylindrical plates 22 radially displaceable on a disk 23 rotatable about the axis 82. To this end the disk 23 has six angularly equispaced and radially extending grooves 24 each receiving a respective rod 27 having a radially inner end provided with rollers 29 and pivoted to a respective link 28. A ring 25 has bores 26 aligned with the grooves 24 and traversed by the respective rods 27. A flange 30 on this ring 25 axially closes the grooves 24, but has slots 83 through which the links 28 can engage. Thus it is possible for these rods 27 to move radially with virtually no friction in the disk 23.

Each arcuate plate 22 has a mounting block 31 formed with an eye 61 having a slot 59 traversed by a pin 60 linking it to the respective rod 27 for pivoting about an axis tangential to an imaginary cylinder centered on the axis 82. A leaf spring 32 fixed to each block 31 has a slot in its middle that the respective rod 27 engages through so that this spring 32 normally urges the plates 22 into a position extending parallel to the axis 82, while of course permitting some pivoting on the pin 60.

The drum 21 is carried on a tube shaft 34 supported by roller bearings in a portion 19 of the arm end 18. A pin 36 projects axially from this shaft 34 into the disk 23 and a nut 37 threaded onto the outer end of the shaft 34 serves to hold the disk 23 snugly in place thereon.

A drive 48 carried on the outer end 18 of the support 16 has a stepping motor 49 whose toothed output sprocket 51 is joined by a criss-cross belt 63 to a large-diameter toothed pulley 52 carried on a shaft 80 with a small-diameter pulley 53 connected in turn by a toothed belt 55 to another large-diameter pulley 54 carried on yet another shaft 81. The opposite end of this shaft 81 carries a small-diameter pulley 56 connected via another toothed belt 58 to a large-diameter pulley 57 mounted on the rear end of the shaft 34, to the opposite side of the part 19 from the disk 23. This drive 48 can be accurately controlled and, as a result of the three-part stepdown, it can rotationally position the drum 21 very accurately.

The part 19 carries a pair of support elements 62 carrying small cylinders 39 and 41 whose piston rods 38 and 40 are connected to a plate 42 traversed by a rod 35 passing axially through the shaft 34. This shaft 35 cannot rotate in the shaft 34, but can move axially relative thereto. Its one end is fixed in a block 33 provided with eyes 84 at which the radially inner ends of the links 28 are pivoted. The other end of this core shaft 35 is held by a screw 45 in a bearing having an outer part 43 and inner part 44 axially embracing the plate 42. The rod 35 can rotate with the drum 21 relative to the plate 42. Thus the cylinders 39 and 41 can axially displace the rod 35, thereby radially displacing the rods 27 and radially positioning the plates 22.

The apparatus described above is operated as follows:

To start with, the cylinders 12, 39, and 41 are fully retracted so that the plates 22 are pulled in, giving the drum 21 minimal diameter, and the drum 21 is elevated and aligned at its top with the sewing station 89 as shown in FIG. 2. In this minimum-diameter starting position it is relatively easy to fit the waistband of a piece of tubular goods 87, here trousers, over the drum 21.

Thereupon, normally by actuation of a foot pedal, the back chambers of all the cylinders 12, 39, and 41 are pressurized so as to synchronously and simultaneously lower the drum 21 and increase its radius, leaving the uppermost portion of the drum 21 horizontally aligned with the station 89. Careful pressurization of these cylinders, whether they are hydraulic or pneumatic, double-acting or spring loaded, allows perfect synchronization to be achieved. The pressure in the cylinders 39 and 41 can be limited to a relatively low maximum level, so the goods 87 will be held snugly without, however, running the risk of splitting them.

In order to ensure proper positioning of the loops 86, the drum 21 is provided with a marking that is aligned with the center rear seam of the goods in this case. Thus once the goods are in position, which can in fact be detected by monitoring the back pressure in the cylinders 39 and 41, the first row of stitching 86' is placed through the one end of the loop 86 and the goods 87. The drum 21 is displaced axially by sliding the rod 7, and the second row 86'' is completed. Then the motor 48 operates to angularly index the drum 21, typically through one-seventh of a full revolution, so that the next loop can be sewn on by repeating the steps described immediately above.

At the end of the cycle, when all of the loops are in place, the cylinders 12, 39, and 41 are all operated, either automatically by a computer-type controller or manually by the operator, to release the goods 87, and the motor 48 returns the drum 21 to its starting position. The cycle can then be repeated.

The advantage of this arrangement is that it need not be adjusted for goods of different sizes. It will automatically accommodate itself perfectly to each different size, so that the goods need not even be done in batches of the same size. All the belt loops of a given size and color can be done at one time on all the differently sized garments needing them. Reloading the loop supply 2 and resetting the finger spacing 85 is all that is needed to change belt loops.

We claim:

1. In combination with a sewing machine having a stitch plate defining a sewing station, an apparatus for holding tubular goods for stitching at the station, the apparatus comprising:

a rotatable support adjacent the sewing station;

means for rotating said support about a horizontal support axis;

at least three arcuate segment plates displaceable radially of said support axis on said rotatable support and together forming a segmented drum centered on said axis and having one of said segment plates uppermost in each position of said drum, said plates being displaceable between inner positions defining a circumference smaller than that of the smallest tubular goods to be sewn and outer positions defining a circumference larger than that of the largest tubular goods to be sewn;

spreading means for radially displacing said plates on said rotatable support and thereby changing the diameter of the drum, whereby when a tubular workpiece is fitted over the drum it is tensioned thereover; and means for displacing said rotatable support vertically adjacent said station and thereby aligning an uppermost segment plate generally with said stitch plate.

2. The goods-holding apparatus defined in claim 1 wherein said support is a disk formed with respective radial guides and said plates have radially extending elements received in said respective guides.

3. The goods-holding apparatus defined in claim 2 wherein said radial elements have radially outer ends pivoted on said respective plates and radially inner ends, said spreading means including an actuating element displaceable axially on said support disk and respective links each having one end pivoted on the respective inner end and an opposite end pivoted on said actuating element.

4. The goods-holding apparatus defined in claim 3 wherein each plate is provided with spring means for urging it into a position extending parallel to said support axis.

5. The goods-holding apparatus defined in claim 3 wherein the means for rotating includes a tube shaft centered on said axis and carrying said support disk, said spreading means further including a core shaft extending coaxially inside said tube shaft and carrying said actuating element.

6. The goods-holding apparatus defined in claim 5, further comprising means for releasably connecting said support disk to said tube shaft and for releasably connecting said actuating element to said core shaft.

7. The goods-holding apparatus defined in claim 5 wherein said core shaft extends through said support disk and has one end on one axial side connected to said actuating element and an opposite end on the other axial side thereof, said spreading means further including an extensible and retractable actuator extending axially and connected to the opposite end of said core shaft.

8. The goods-holding apparatus defined in claim 3 wherein said means for vertically displacing said support includes a pivotal arm having an outer end rotatably carrying said support disk;

a relatively stationary frame on which the other end of said arm is pivoted; and an extensible and retractable actuator connected between said frame and said arm between the ends thereof.

9. The goods-holding apparatus defined in claim 8 wherein said means for rotating includes a stepping motor.

10. The goods-holding apparatus defined in claim 3, further including control means for synchronizing the rotation and vertical displacement of said drum so that same is moved vertically through a distance generally equal to its change in radius as said segment plates move between the inner and outer positions.

11. The goods-holding apparatus defined in claim 1, further comprising support means for limited axial movement without rotational or vertical movement of said drum relative to said sewing machine.

12. The goods-holding apparatus defined in claim 1, further comprising supply means for supplying belt loops to be stitched to said sewing station and for positioning said belt loops on the goods in said station.

* * * * *